US007325689B2

(12) United States Patent
Buss

(10) Patent No.: US 7,325,689 B2
(45) Date of Patent: Feb. 5, 2008

(54) CUSTOMIZABLE FOLD-OVER CARD

(75) Inventor: Michael Buss, Breinigsville, PA (US)

(73) Assignee: Fisher Clinical Services, Allentown, PA (US)

( * ) Notice: Subject to any disclaimer, the term of this patent is extended or adjusted under 35 U.S.C. 154(b) by 456 days.

(21) Appl. No.: 10/925,235

(22) Filed: Aug. 24, 2004

(65) Prior Publication Data

US 2006/0042987 A1 Mar. 2, 2006

(51) Int. Cl.
*B65D 83/04* (2006.01)

(52) U.S. Cl. ..... 206/532; 206/538; 206/539

(58) Field of Classification Search ..... 206/528, 206/531, 532, 534, 538, 539; 229/125.125
See application file for complete search history.

(56) References Cited

U.S. PATENT DOCUMENTS

| | | | |
|---|---|---|---|
| 2,652,149 | A | 9/1953 | O'Meara |
| 3,381,808 | A | 5/1968 | McGraw, II |
| 3,630,346 | A | 12/1971 | Burnside |
| 3,809,221 | A | 5/1974 | Compere |
| 3,835,995 | A | 9/1974 | Haines |
| 3,888,350 | A | 6/1975 | Horvath |
| 3,921,805 | A | 11/1975 | Compere |
| 3,931,885 | A | 1/1976 | Nahill et al. |
| 3,941,248 | A | 3/1976 | Moser et al. |
| 4,113,098 | A | 9/1978 | Howard |
| 4,125,190 | A | 11/1978 | Davie, Jr. et al. |
| 4,126,224 | A | 11/1978 | Laauwe |
| 4,192,422 | A | 3/1980 | Kotyuk |
| 4,211,329 | A | 7/1980 | Braverman |

(Continued)

FOREIGN PATENT DOCUMENTS

EP 0 393 942 A 10/1990

(Continued)

OTHER PUBLICATIONS

Key-Oak Child Resistant Senior Friendly Blister Card, Indication of Patent Pending. Keystone Folding Box Co., Newark, NJ.

(Continued)

*Primary Examiner*—David T. Fidei
(74) *Attorney, Agent, or Firm*—Workman Nydegger

(57) ABSTRACT

A pharmaceutical package assembly includes a tether having a fold-over card mating feature, and a fold-over card configured to house one or more pharmaceutical blisters, wherein the fold-over card includes a tether mating feature. One exemplary method of coupling the fold-over card to a tether includes forming a tether receiving recess in the front side of the fold-over card, folding the front side of the fold-over card adjacent to the back side of the fold-over card so that the tether receiving recess reveals an exposed portion of the fold-over card front side, and coupling the tether to the revealed portion of the card front side. Another exemplary method of coupling a fold-over card to a tether having a front side and a back side includes forming a fold-over card receiving recess in the tether such that when the front side of the tether is folded adjacent to the back side of the tether, the fold-over card receiving recess reveals an exposed portion of the tether, and coupling the fold-over card to the revealed portion of the tether.

34 Claims, 8 Drawing Sheets

U.S. PATENT DOCUMENTS 4,294,361 A 10/1981 Margulies et al.
4,340,141 A 7/1982 Fischer
4,364,488 A 12/1982 Anjou
4,398,634 A 8/1983 McClosky
4,401,210 A 8/1983 Anjou
4,506,789 A 3/1985 Dlugosz
4,537,312 A 8/1985 Intini
4,553,670 A 11/1985 Collens
4,561,544 A 12/1985 Reeve
4,567,986 A 2/1986 Eastwood
4,669,613 A 6/1987 Collens
4,844,284 A 7/1989 Drozd et al.
4,884,693 A 12/1989 Brutsch
4,974,729 A 12/1990 Steinnagel
4,988,004 A 1/1991 Intini
5,046,618 A 9/1991 Wood
5,080,222 A 1/1992 McNary
5,082,137 A 1/1992 Weinstein
5,088,603 A 2/1992 Kirkpatrick
5,172,812 A 12/1992 Wharton et al.
5,242,055 A 9/1993 Pora
5,275,291 A 1/1994 Sledge
5,310,060 A 5/1994 Bitner et al.
5,323,907 A 6/1994 Kalvelage
5,325,968 A 7/1994 Sowden
5,329,750 A 7/1994 Bagley et al.
5,339,960 A 8/1994 Price
5,346,069 A 9/1994 Intini
5,437,371 A 8/1995 Lataix
5,469,968 A 11/1995 Matthews et al.
5,489,025 A 2/1996 Romick
5,511,665 A 4/1996 Dressel et al.
5,551,567 A 9/1996 Malone et al.
5,755,462 A 5/1998 Lupi
5,758,774 A 6/1998 Leblong
5,775,505 A 7/1998 Vasquez et al.
5,785,180 A 7/1998 Dressel et al.
5,833,072 A 11/1998 Lambelet, Jr.
5,862,915 A 1/1999 Plezia et al.
5,878,887 A 3/1999 Parker et al.
5,878,888 A 3/1999 Faughey et al.
5,894,930 A 4/1999 Faughey et al.
5,908,208 A 6/1999 Lapsker
5,915,559 A 6/1999 Hulick et al.
5,927,500 A 7/1999 Godfrey et al.
5,944,191 A 8/1999 Ray et al.
6,021,901 A 2/2000 Wolfe
6,024,222 A 2/2000 Friberg et al.
6,032,795 A * 3/2000 Ehrlund et al. ..... 206/312
6,036,016 A 3/2000 Arnold
6,047,829 A 4/2000 Johnstone et al.
6,161,699 A 12/2000 Gartland
6,230,894 B1 5/2001 Danville
6,273,260 B1 8/2001 ColDepietro et al.
6,338,407 B2 1/2002 Danville
6,349,831 B1 2/2002 Buss
6,375,956 B1 4/2002 Hermelin et al.
6,394,275 B1 5/2002 Paliotta et al.
6,412,636 B1 7/2002 Jones et al.
6,422,391 B1 7/2002 Swartz
6,491,211 B1 12/2002 Evans et al.
6,543,209 B1 4/2003 Siegel et al.
6,571,790 B1 6/2003 Weinstein
D478,810 S 8/2003 Wilson
6,681,935 B1 1/2004 Lewis
6,708,825 B2 3/2004 Filion et al.
6,726,015 B2 4/2004 Hulick
6,752,272 B2 6/2004 Jones et al.
2003/0062287 A1 4/2003 Gelardi et al.
2004/0050748 A1 * 3/2004 Ehrlund ..... 206/538
2004/0182738 A1 9/2004 Williams-Hartman
2005/0274644 A1 12/2005 Williams-Hartman

FOREIGN PATENT DOCUMENTS

EP 1 293 436 A 3/2003
FR 2 764 274 A 12/1998
WO WO 00/15518 A 3/2000
WO WO/02/18229 A1 3/2002
WO WO 2004/085266 A2 10/2004

OTHER PUBLICATIONS

International Search Report for PCT/US2005/025358 issued Nov. 15, 2005.

* cited by examiner

CUSTOMIZABLE FOLD-OVER CARD

BACKGROUND

It is generally known that pharmaceutical products may be distributed in a variety of forms. Single dose pharmaceutical products are commonly available in tablets, lozenges, capsules, and the like. It is also known that single dose pharmaceutical products may be packaged in a number of well-known package housing structures including child resistant packaging. Many of the well-known package housing systems secure the pharmaceutical products inside pharmaceutical fold-over cards.

Many traditional fold-over cards typically include a one-piece structure combining a plurality of pharmaceutical securing layers and a tether. The pharmaceutical securing layers fix the pharmaceutical products in place while the tether is configured to couple the fold-over card to a pharmaceutical shell package housing.

As the treatment of illnesses and consequently the administration of pharmaceuticals becomes increasingly customized, packaging configurations are also becoming customized. Customization of packaging configurations allows producers to complement pharmaceutical packaging with custom dosages of pharmaceuticals, multiple pharmaceutical arrangements, and varying pharmaceutical quantities and sizes, either in a single blister package or a combination thereof. Customization of packaging configurations is also beneficial when implementing clinical trials conducted to evaluate a new treatment or drug. The customized packaging can be specifically configured with new pharmaceuticals and placebo to satisfy testing requirements of the United States Food and Drug Administration (FDA) and other clinical trials. Rapid production of the customized packages, as well as their associated housings, reduces the time necessary for a pharmaceutical to be available for general clinical use.

However, as custom packages associated with a customized distribution or arrangement of pharmaceuticals is requested, new tooling and/or complete package re-design is often needed to produce desired custom packages. Consequently, each request for a customized arrangement of pharmaceuticals entails designing and manufacturing an entirely new fold-over card, including the plurality of pharmaceutical securing layers that correspond with the new arrangement of pharmaceuticals and the tether associated with various packaging structures of the customized pharmaceutical packaging. Each time the pharmaceutical packaging or pharmaceutical arrangement changes, the reconfiguration of tooling and complete fold-over card design introduce an added delay to the release of the pharmaceutical product. That is, the need to retool each time a new pharmaceutical packaging or configuration is developed is not only monetarily expensive but is also temporally expensive. Time delays in the pharmaceutical industry are detrimental because time is of the essence in order to treat human ailments or complete clinical trials where release of a product to consumers depends on the satisfactory completion of the clinical trial.

SUMMARY

A pharmaceutical package assembly includes a tether having a fold-over card mating feature, and a fold-over card configured to house one or more pharmaceutical blisters, wherein the fold-over card includes a tether mating feature.

One exemplary method of coupling a fold-over card having a front side and a back side to a tether includes forming a tether receiving recess in the front side of the fold-over card, folding the front side of the fold-over card adjacent to the back side of the fold-over card so that the tether receiving recess reveals an exposed portion of the fold-over card front side, and coupling the tether to the revealed portion of the card front side.

Another exemplary method of coupling a fold-over card to a tether having a front side and a back side includes forming a fold-over card receiving recess in the tether such that when the front side of the tether is folded adjacent to the back side of the tether, the fold-over card receiving recess reveals an exposed portion of the tether, and coupling the fold-over card to the revealed portion of the tether.

BRIEF DESCRIPTION OF THE DRAWINGS

The accompanying drawings illustrate various embodiments of the present system and method and are a part of the specification. The illustrated embodiments are merely examples of the present system and method and do not limit the scope thereof.

Throughout the drawings, identical reference numbers designate similar, but not necessarily identical, elements.

DETAILED DESCRIPTION

A number of exemplary systems and methods for producing a customizable fold-over card are described herein. More specifically, the present exemplary systems and methods provide for independently forming a customized fold-over card assembly and an associated tether. Separately forming the fold-over card assembly and the tether allows for the independent modification of either the fold-over card assembly or the tether without the added cost and delay associated with re-tooling and producing an entirely new fold-over card and tether assembly.

As used in this specification and in the appended claims, the term "pharmaceutical" is meant to be understood broadly as any medicinal structure or edible casing configured to house a substance related to a medicinal treatment. The medicinal structure can include an active ingredient for an approved medical treatment, a medical treatment being evaluated, or a placebo ingredient used during clinical trials to compare against the medical treatment being evaluated (i.e., a placebo capsule). The term "pharmaceutical housing" is meant to be understood broadly as referring to any structural configuration aimed at securing and/or protecting a pharmaceutical dosage. In some embodiments, the pharmaceutical housing may include a single or multiple pharmaceutical dosages. The present system and method may be used to securely couple the pharmaceutical housing to any number of pharmaceutical packages, as will be explained in detail below.

Moreover, as used in the present specification, and in the appended claims, the term "tether" is meant to be understood broadly as any material or extrusion configured to restrain or secure a first object to a second object. Accordingly, a tether may be a simple tab extruding from a housing or a complex coupling system. Additionally, as used in the present specification and in the appended claims, the term "tether" may also be applied to any component coupled to a fold-over card which may include instructions, may represent an element of child-resistant pharmaceutical packaging, or may be provided for other known purposes or for a combination of such purposes.

In the following description, for purposes of explanation, numerous specific details are set forth to provide a thorough understanding of the present systems and methods for forming a customizable fold-over card. It will be apparent, however, to one skilled in the art, that the present systems and methods may be practiced without these specific details. Reference in the specification to "one embodiment" or "an embodiment" means that a particular feature, structure, or characteristic described in connection with the embodiment is included in at least one embodiment. The appearance of the phrase "in one embodiment" in various places in the specification are not necessarily all referring to the same embodiment.

Figure 1:
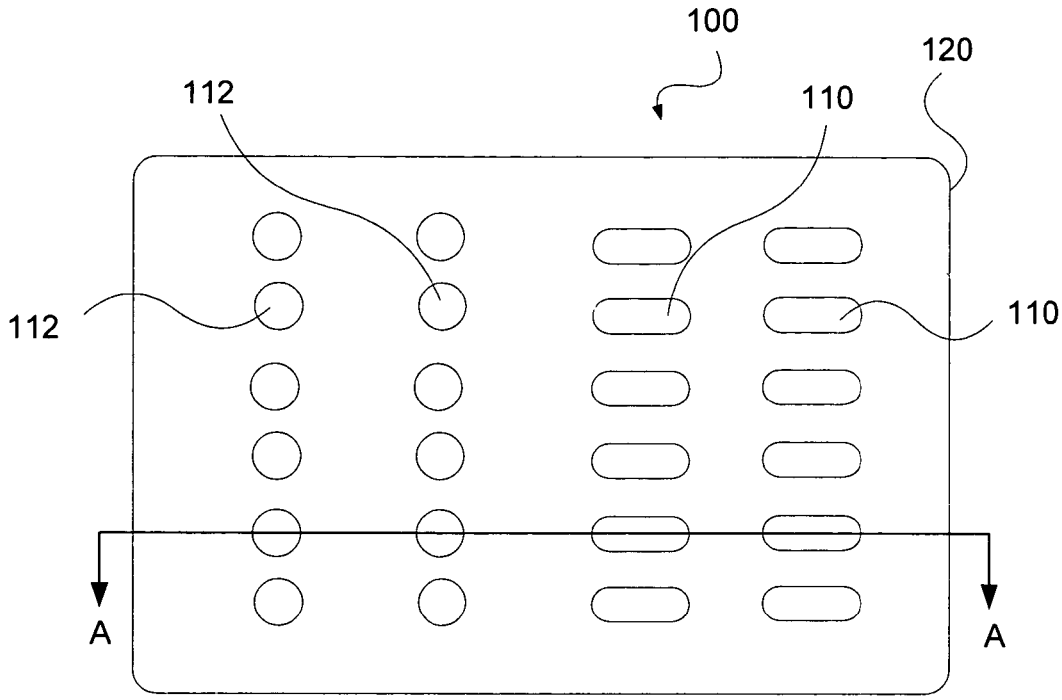
FIG. 1 is a top view illustrating a pharmaceutical package, according to one exemplary embodiment.

Turning now to the Figures, FIG. 1 illustrates a pharmaceutical blister pack (100), according to one exemplary embodiment. As illustrated in FIG. 1, the pharmaceutical blister pack (100) includes a number of pharmaceutical blisters (110, 112) configured to hold a quantity of a pharmaceutical product such as a plurality of pills, capsules, tablets, or the like, and has a structure that is generally known in the art. As illustrated in FIG. 1, the pharmaceutical blister pack (100) includes a blister surface (120) having a number of pharmaceutical blisters (110, 112) formed therein. The pharmaceutical blisters may vary in size and shape to accommodate any number of pharmaceutical products. As shown in FIG. 1, the pharmaceutical blisters may include small tablet blisters (112) configured to receive pills and other small units of medication, or larger capsule blisters (110). The structure of the pharmaceutical blister pack (100) and its operation will be discussed in further detail below.

Figure 2:
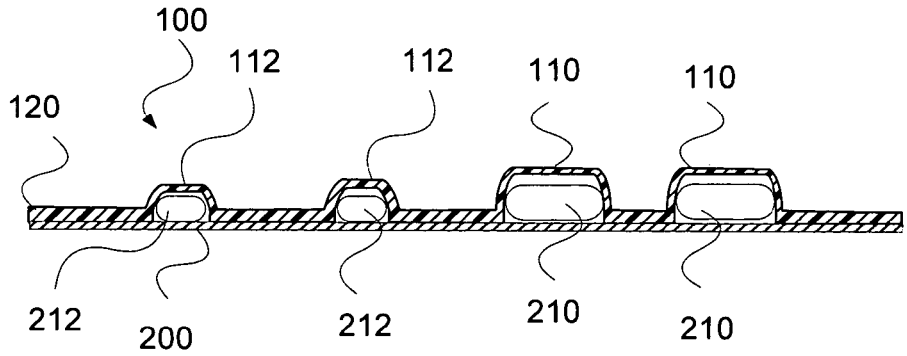
FIG. 2 is a cross-sectional side view along line A-A illustrating the components of a pharmaceutical package, according to one exemplary embodiment.

FIG. 2 is a cross-sectional view illustrating the pharmaceutical blister pack (100) of FIG. 1 sectioned along the line A-A. As shown in FIG. 2, the pharmaceutical blister pack (100) is generally operable to hold a quantity of pharmaceutical products, such as a plurality of tablets (212), capsules (210), or the like, and has a structure that is generally known in the art. Accordingly, the pharmaceutical blister pack (100) is shown generally as having an upper blister surface (120) of thermoplastic blister material with a plurality of resilient pharmaceutical blisters (110, 112) formed therein.

Additionally, as illustrated in FIG. 2, the pharmaceutical blister pack (100) includes a lidding (200) layer configured to hermetically seal each pharmaceutical blister (110, 112) until a force or other means is applied to separate, rupture, or remove the lidding, allowing access to the pharmaceutical product (210, 212). The lidding (200) may be made out of any number of easily rupturing materials including, but in no way limited to, foil, perforated plastic, and/or paper based material. As illustrated in FIG. 2, the lidding (200) may be coupled to the plastic blister surface (120) in a planar fashion. In other words, the lidding (200) may linearly span the gaps created by the pharmaceutical blisters (110, 112). An adhesive may also be included between the lidding (200) and the plastic blister surface (120). The adhesive (not shown) may be such that upon the application of heat, the lidding (200) adheres to the plastic blister surface (120) while not adhering to the gaps created by the pharmaceutical blisters (110, 112). While the present system and method are described herein in the context of a thermoplastic based pharmaceutical blister pack (100), any generally planar structure for storing and dispensing pharmaceutical products may be incorporated by the present system and method.

Figure 3A:
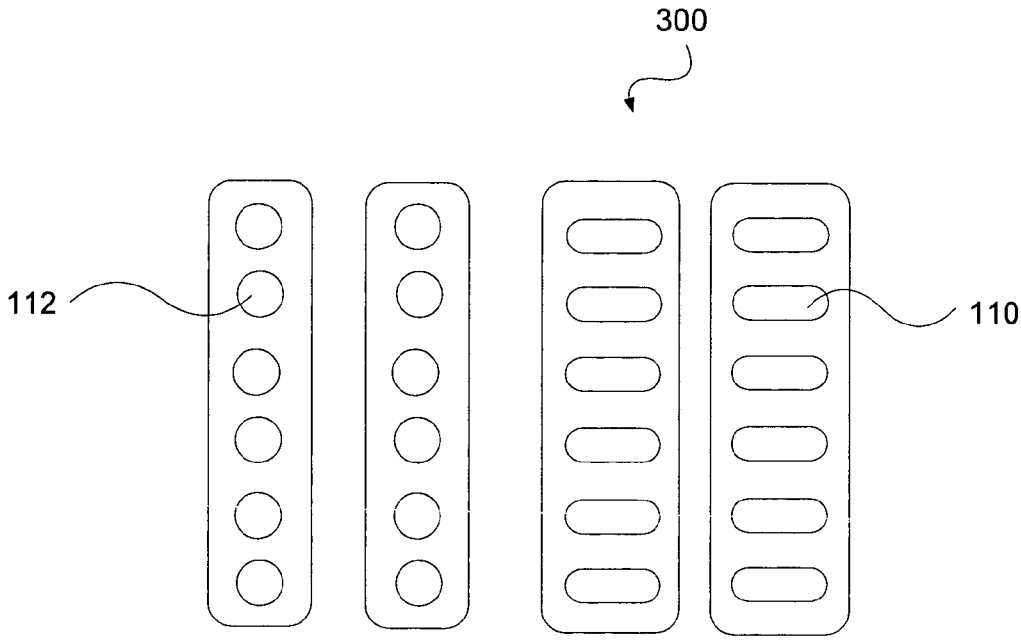
FIG. 3A is a top view illustrating a number of exemplary blister strips containing pharmaceutical products, according to one exemplary embodiment.

FIG. 3A illustrates a number of pharmaceutical blister strips (300) that may also be enclosed within a blister card in place of, or in addition to the blister pack (100; FIG. 1) to form a customized dosage of medication. As illustrated in FIG. 3A, the blister strips embrace any number of pharmaceutical products including, but in no way limited to, capsules or pills. As shown, the blister strips (300) include a single row of tablet (112) or capsule (110) blisters, and have a similar construction as the pharmaceutical blister pack (110; FIG. 1) illustrated above. Additionally, a blister strip (300) may include any combination of tablet (112), capsule (110), and other shape blisters in a single strip.

Figure 3B:
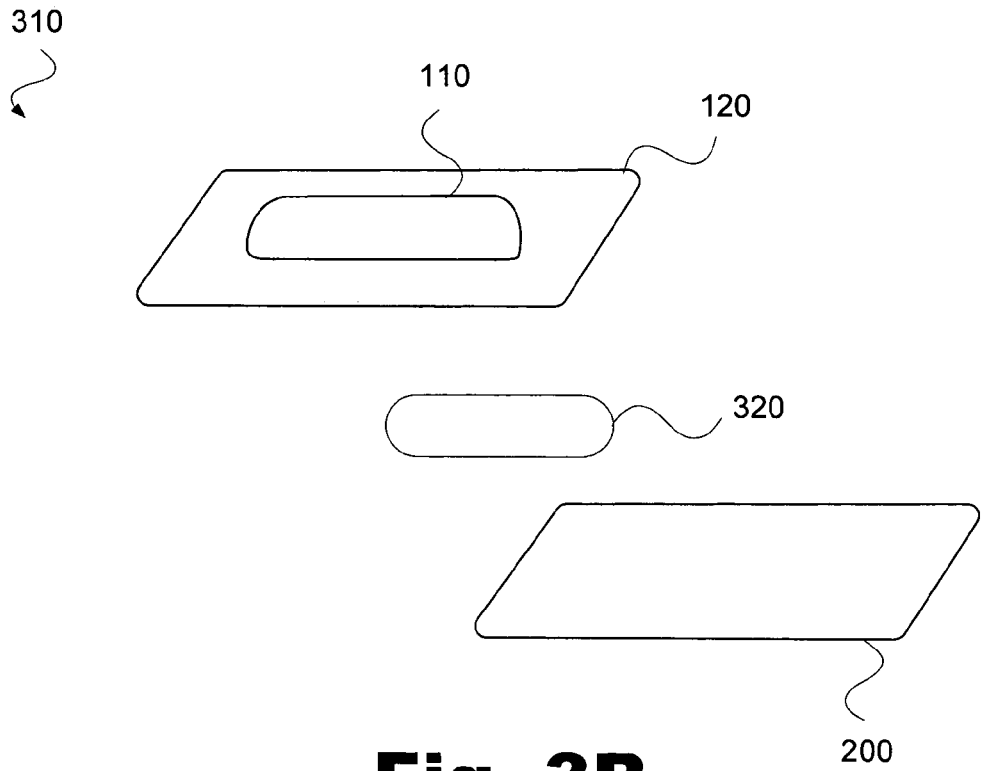
FIG. 3B is an exploded perspective view illustrating the components of a single dose pharmaceutical product, according to one exemplary embodiment.

FIG. 3B illustrates yet another planar structure that may be used to store and dispense customized pharmaceutical dosages via a fold-over blister card. As illustrated in FIG. 3B, an individual dosage blister (310) may be used to provide a single pharmaceutical to a customized configuration. As shown, an individual dosage blister (310) may include a plastic blister surface (120) having a capsule (110) or a tablet (112; FIG. 2) blister formed therein. A single pharmaceutical (320) in the form of a capsule or a tablet may then be inserted into the capsule blister (110) and sealed by the lidding layer (200), as described above.

Using the various pharmaceutical blister packages illustrated in FIGS. 1 through 3B, any number of customized dosages can be generated. However, as noted previously, traditional fold-over blister cards are ill-equipped to be rapidly modified to receive and secure the customized dosages. Rather, reception of a customized dosage of blister strips (300) and individual dosage blisters (310) by a traditional one-piece fold-over blister card entails the temporally and monetarily expensive re-tooling of manufacturing apparatuses to form a new fold-over card and tether combination sufficient to adequately secure the customized dosages.

Figure 4:
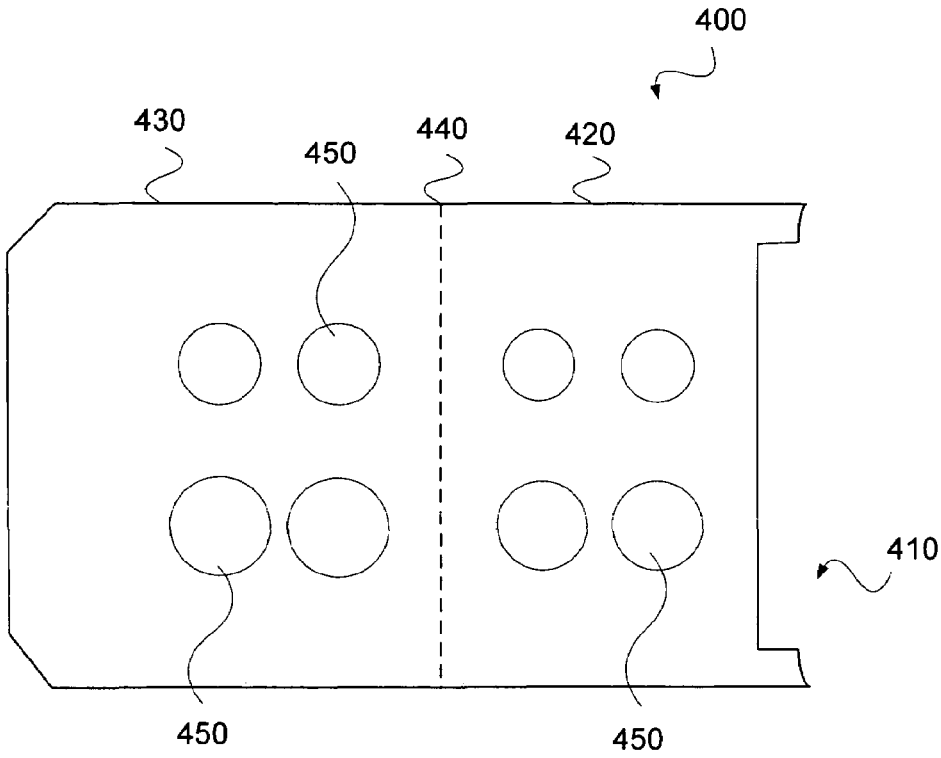
FIG. 4 is a top view illustrating a pre-assembly fold-over blister card, according to a first exemplary embodiment.

FIGS. 4 through 11B illustrate a first and second exemplary system and method for reducing the time and money associated with producing a customized pharmaceutical dosage, tether, and housing. As illustrated in FIG. 4, a fold-over card (400) may be formed independently from the tether. As shown, the fold-over card (400) is configured to both securely house a number of pharmaceutical blisters while being securely coupled, via an associated tether (120; FIG. 1), to a package housing, instruction sheet, or other desired substrate. As illustrated in FIG. 4, the fold-over card (400) is constructed, for the most part, like the pharmaceutical securing layers of traditionally known fold-over cards. As illustrated, the fold-over card (400) includes a card front (430) and a card back (420) separated by a folding seam (440). Additionally, as illustrated in the exemplary embodiment of FIG. 4, corresponding pharmaceutical access orifices (450) are formed in both the card front (430) and the card back (420). By forming access orifices in both the front card (430) and the card back (420), the blisters (110, 112; FIG. 1) may protrude through one orifice while providing little or no support to the lidding (200; FIG. 2) on the opposite side of the pharmaceutical blister (110, 112; FIG. 2).

According to the exemplary embodiment illustrated in FIG. 4, the fold-over card (400) is configured to be folded along the folding crease (440) to concentrically align pharmaceutical access orifices (450) disposed on the card front (430) with corresponding pharmaceutical access orifices (450) disposed on the card back (420). When folded, either single blisters, blister strips, and/or blister cards may be securely coupled between the card front (430) and the card back (420) to be accessed through the pharmaceutical access orifices (450). This ability to couple combinations of blisters (310; FIG. 3B), blister strips (300; FIG. 3A), and/or blister packs (100; FIG. 1) allows for the flexibility to design custom dosages within a single fold-over card (400).

Figure 5:
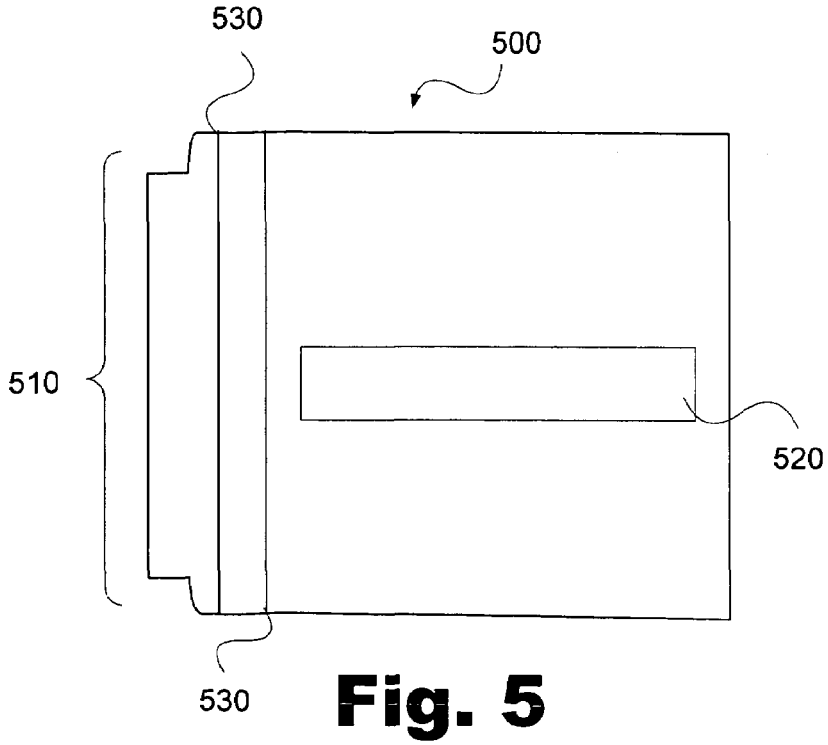
FIG. 5 is a top view illustrating a pre-assembly tether, according to a first exemplary embodiment.

However, in contrast to traditional fold-over cards, the present exemplary fold-over card (400) also includes a tether receiving recess (410) formed in the card back (420) portion of the fold-over card (400). According to the exemplary embodiment illustrated in FIG. 4, the tether receiving recess (410) is formed as the mating equivalent of a fold-over card mating member (510) associated with a tether (500), as illustrated in FIG. 5. That is, both the tether receiving recess (410) and the fold-over card mating member (510) have substantially similar surface profiles on one edge. As shown in FIG. 5, the tether (500) includes a fold-over card mating member (510) configured to mate with the tether receiving recess (410; FIG. 4) of the fold-over card (400) when folded, as will be illustrated below with reference to FIGS. 8 through 11B.

Additionally, FIG. 5 illustrates a housing mating member (520) and a plurality of folds (530) formed in the tether (500). According to the present system and method, any number of housing mating members (520) and/or folds (530) may be formed in the tether (500) to aid in the coupling of the tether to a desired pharmaceutical package housing, as will be further explained below with reference to FIGS. 11A and 11B.

Figure 6:
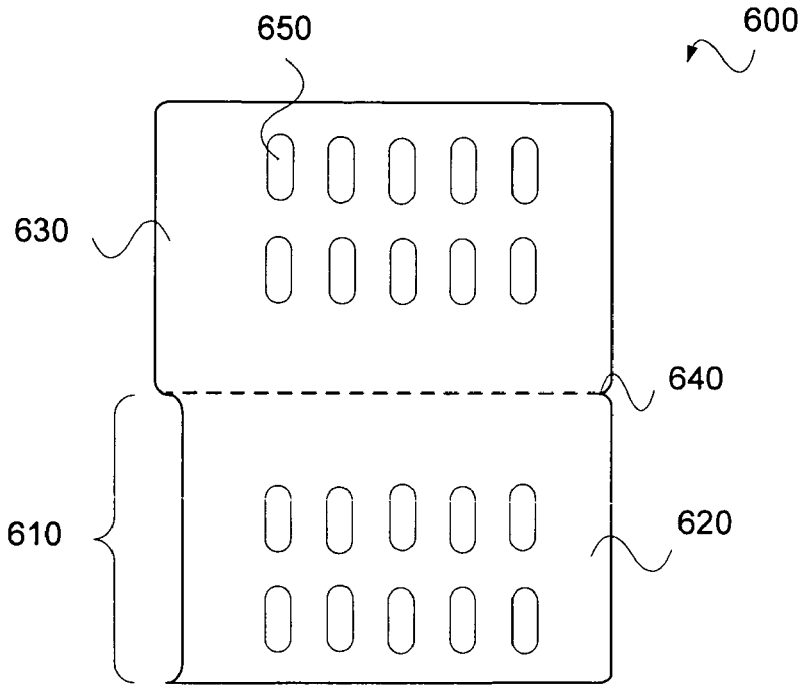
FIG. 6 is a top view illustrating a pre-assembly fold-over blister card, according to a second exemplary embodiment.
Figure 7:
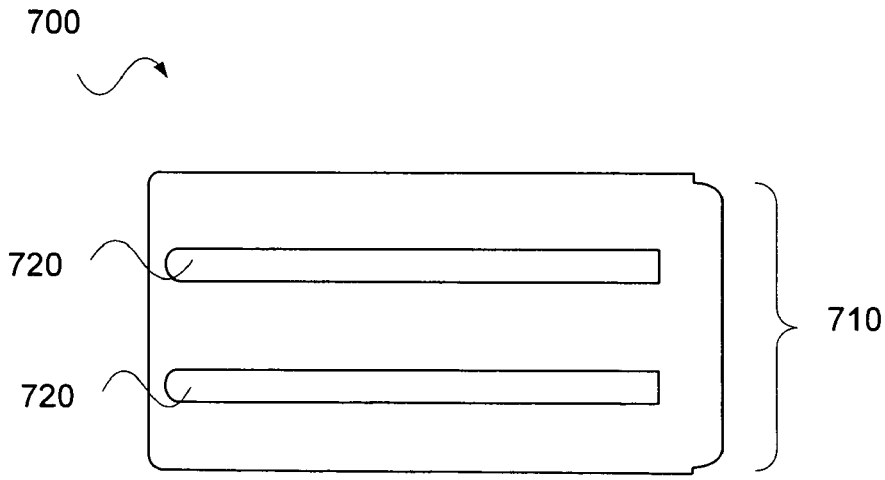
FIG. 7 is a top view illustrating a sliding tether, according to a first exemplary embodiment.

FIGS. 6 and 7 illustrate a second exemplary embodiment of the fold-over card (600) and an associated sliding tether (700). As illustrated in FIG. 6, the pharmaceutical access orifices (650) formed in the fold-over card (600) may be formed in any number of shapes corresponding to a capsule blister (110; FIG. 1), a pill blister (112; FIG. 1), or any other pharmaceutical blister. Additionally, FIG. 6 illustrates that the pharmaceutical access orifices (650) formed in the fold-over card (600) may assume any orientation corresponding to one or more pharmaceutical blister packs (100; FIG. 1), pharmaceutical blister strips (300; FIG. 3A), individual dosage blisters (310; FIG. 3B), or any appropriate combination thereof. FIG. 6 illustrates a capsule fold-over card (600) having oval shaped pharmaceutical access orifices (650) configured to receive a capsule blister pack, strips, or single dosages. Similar to the fold-over card illustrated in FIG. 4, the fold-over card (600) illustrated in FIG. 6 includes a crease (640) separating the card front (630) and the card back (620). When the fold-over card is doubled along the crease (640), pharmaceutical access orifices (650) formed in the card front (630) will be concentrically aligned with corresponding pharmaceutical access orifices formed in the card back (620). Additionally, the fold-over card (600) illustrated in FIG. 6 includes a tether receiving recess (610) configured to facilitate the coupling of a tether to the fold-over card.

FIG. 7 illustrates an exemplary sliding tether (700) configured to couple the fold-over card (600; FIG. 6) to a pharmaceutical package housing, an instruction sheet, an ornamental package, etc. As illustrated, a number of housing mating members (720) may be formed in the sliding tether (700) to aid in the coupling of the fold-over card (600) to a pharmaceutical package housing. Additionally, the sliding tether (700) includes a fold-over card mating member (710) configured to be securely coupled to the pharmaceutical fold-over card (600; FIG. 6), as mentioned previously. The tether receiving recess (610; FIG. 6) of the fold-over card (600; FIG. 6) and the corresponding fold-over card mating member (710) allow for customized fold-over cards (600; FIG. 6) and tethers (700) to be independently designed and manufactured, to be later coupled during assembly.

The ability to independently produce either the fold-over card design (600; FIG. 6) or the tether (700) design allows new fold-over card designs and/or tether designs to be joined to previously formed components. This joining ability adds flexibility to independently modify the design of either the fold-over card or the tether without a re-tooling of all the production apparatuses. More specifically, the fold-over card assembly and the tether configuration may be independently varied in any manner so long as the tether receiving recess (610) and the associated fold-over card mating member (710) correspond. Consequently, any number of tethers (700) having various housing mating members (720) formed therein can be selectively coupled to an almost infinitely variable configuration of fold-over card designs (600; FIG. 6), provided that the tether includes a fold-over card mating member (710) that corresponds to the tether receiving recess (610) of the fold-over card assembly. This system and method not only allow for rapid mixing and matching of various tethers with customizable fold-over cards, but this system and method also allow producers to stockpile various tethers and their associated housings to be used with any number of stockpiled or newly developed fold-over card assemblies.

Figure 8:
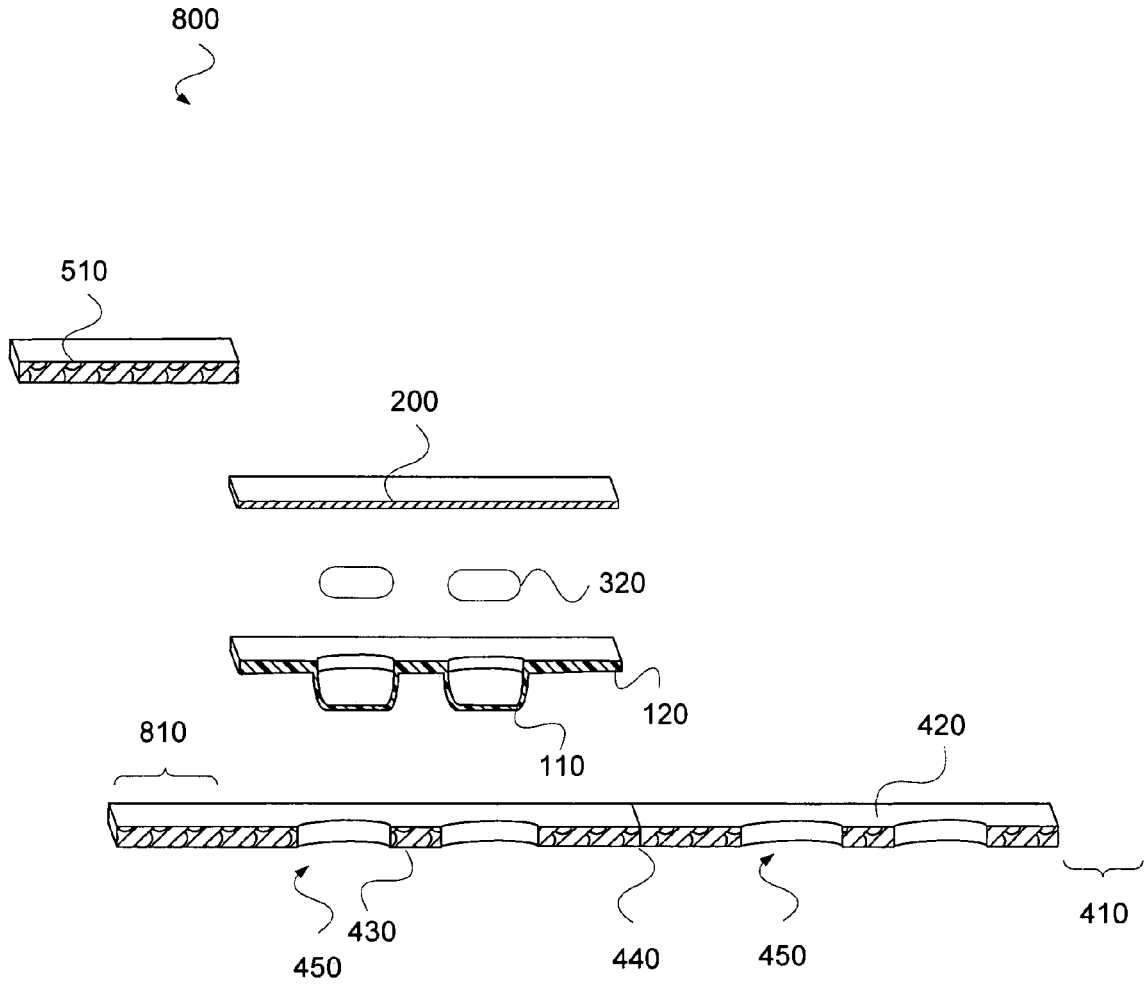
FIG. 8 is an exploded cross-sectional perspective view illustrating the components of a fold-over blister card, according to one exemplary embodiment.

FIG. 8 is an exploded cross-sectional view illustrating the components of a fold-over card assembly (800) prior to assembly. As illustrated in FIG. 8, the fold-over card mating member (510) of the tether (500; FIG. 5) is disposed adjacent to a tether receiving surface (810) of the card front (430) that remains exposed during assembly due to the positioning of the tether receiving recess (410). Additionally, the components of one or more pharmaceutical blister packs, strips, or dosages are illustrated including, a capsule blister (110) formed in a blister surface (120), one or more pharmaceuticals (320), and a layer of lidding (200). As illustrated in FIG. 8, the capsule blisters (110) are aligned with corresponding pharmaceutical access orifices (450) that are formed in the card front (430). While the present system and method is described in the context of a fold-over card assembly (800) having the tether receiving surface (810) on the card front (430), the tether receiving surface and the tether receiving recess (410) may alternatively be on either the card front (430) or the card back (420).

Figure 9:
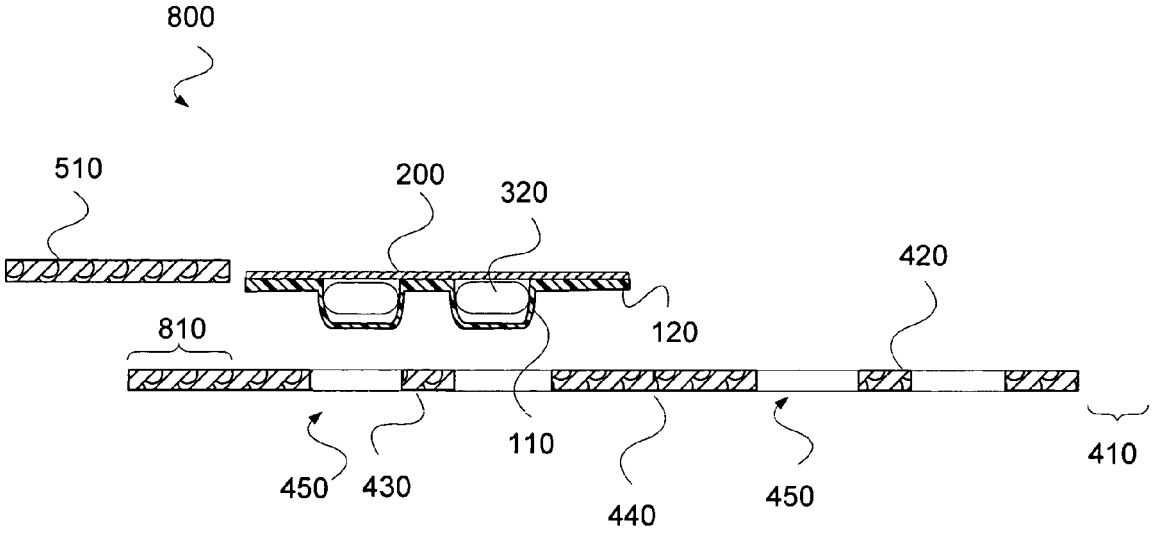
FIG. 9 is an exploded cross-sectional view of a fold-over blister card and tether assembly, according to a first exemplary embodiment.
Figure 10:
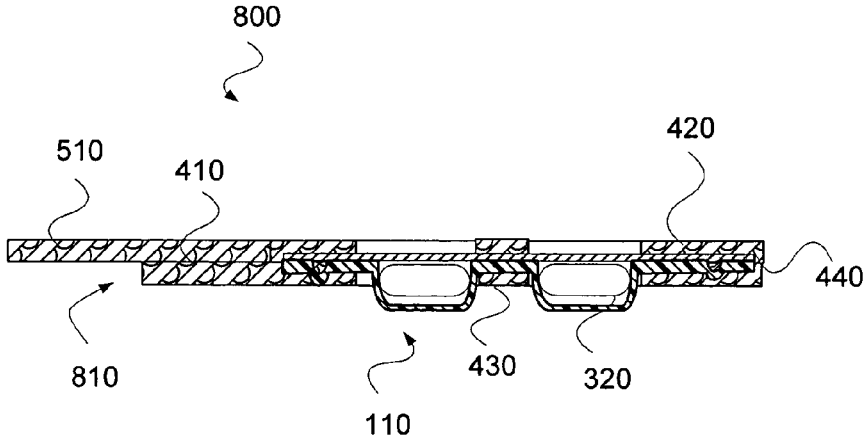
FIG. 10 is a cross-sectional view illustrating an assembled fold-over blister card and tether, according to a first exemplary embodiment.

When the one or more pharmaceutical blister packs, strips, or dosages are assembled as illustrated in FIG. 9, the capsule blisters (110) may be passed through their corresponding pharmaceutical access orifices (450) and the fold-over card assembly (800) may be assembled to secure the blister packs, strips, or dosages, as shown in the cross-sectional view illustrated in FIG. 10. As shown in FIG. 10, the card back (420) is folded along the crease (440) to mate with the card front (410) thereby securing the one or more pharmaceutical blister packs, strips, or dosages between the card front (430) and the card back (420).

FIG. 10 further illustrates that when the card back (420) is folded along the crease (440), a tether receiving surface (810) of the card front (430) is not mated with the card back (420) due to the location of the tether receiving recess (410) formed in the card back (420). As illustrated in FIG. 10, the exposed tether receiving surface (810) may be used to securely couple the fold-over card assembly (800) to a fold-over card mating member (510) of a tether (500; FIG. 5). According to one exemplary embodiment, during formation, an adhesive such as, but in no way limited to, a standard heat-sealing adhesive is disposed on the tether receiving surface (810) of the fold-over card assembly (800), followed by the joining of the fold-over card mating member (510) to the heat-sealing adhesive, and consequently the fold-over card assembly (800). Once joined, thermal energy may be applied to further cure the heat-sealing adhesive, thereby coupling the fold-over card assembly (800), including the one or more pharmaceutical blister packs, strips, or dosages to a tether (500; FIG. 5). Alternatively, any number of fasteners may be used to securely couple the fold-over card assembly (800) to the tether (500; FIG. 5) including, but in no way limited to, staples, clips, thread, etc. Additionally, an adhesive may be disposed between mating surfaces of the card front (430) and the card back (420), thereby securing the pharmaceutical blister packs, strips, or dosages between them.

Figure 11A:
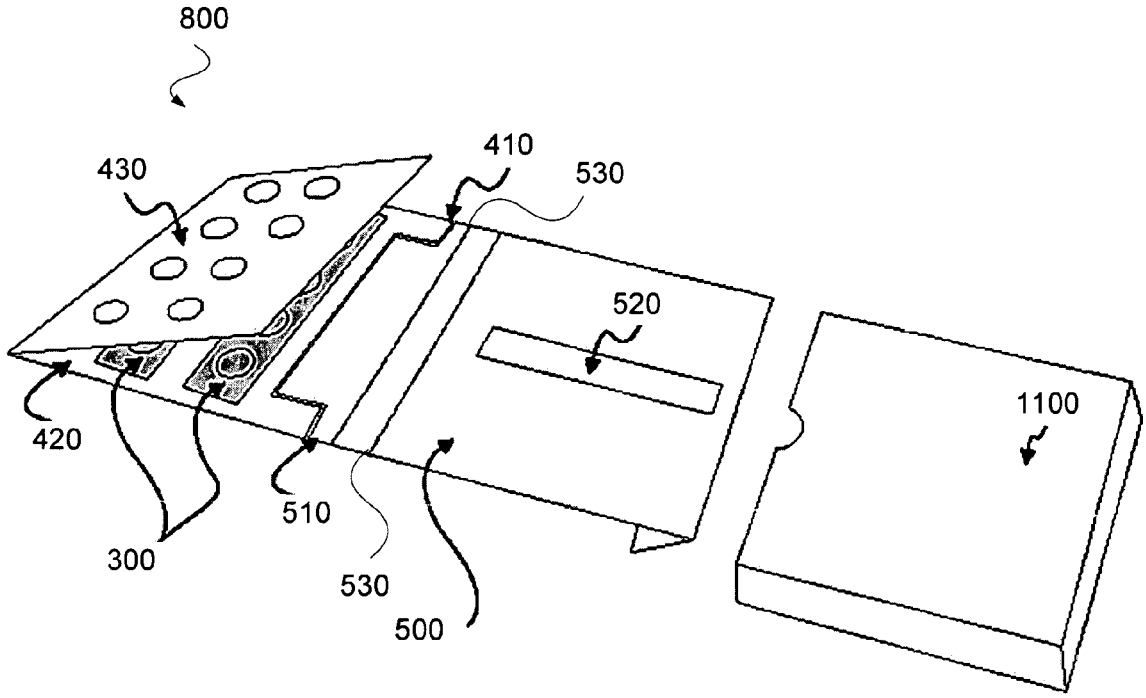
FIGS. 11A and 11B are perspective views illustrating the assembly of a fold-over blister card into a package housing, according to one exemplary embodiment.

FIG. 11A illustrates an exemplary insertion of an assembled fold-over card assembly (800) and tether (500) into a package housing (1100), according to one exemplary embodiment. As illustrated in FIG. 11A, the tether (500) includes a number of housing mating members (520) formed therein that correspond to the desired package housing (1100). During insertion, the housing mating members (520) are received by corresponding extrusions (not shown) formed in the package housing (1100).

FIG. 11A also further illustrates the coupling of the fold-over card assembly (800) to the fold-over card mating member (510), according to one exemplary embodiment. As illustrated in FIG. 11A, the fold-over card mating member portion (510) of the tether (500) is received by the tether receiving recess (410) formed in the fold-over card assembly (800). One or more pharmaceutical strips (300), blister packs, or single dosages are then placed between the card front (430) and the card back (420) of the fold-over card assembly (800) such that their blisters are aligned with their corresponding pharmaceutical access orifices (450). Once the one or more pharmaceutical blister packs, strips, or single dosages are correctly positioned, the fold-over card assembly (800) is then folded over, causing the card front (430) and the card back (420) to securely couple the one or more pharmaceutical blister packs, strips, or single dosages there between. Additionally, when folded, the card front (430), being longer than the card back (420), overlaps the card back and is coupled to the fold-over card mating member (510). In this manner, the tether (500) may be securely coupled to a customized fold-over card assembly (800) without sacrificing pharmaceutical housing area.

Figure 11B:
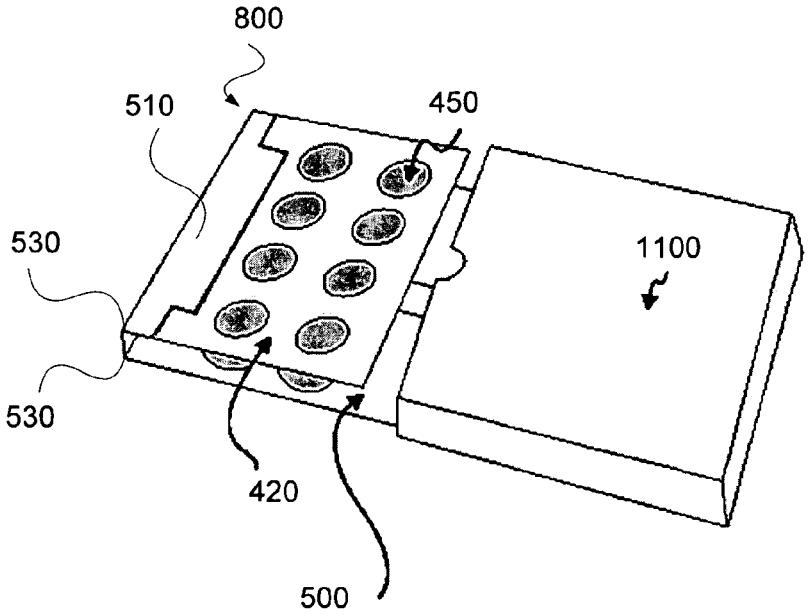

Once the fold-over card assembly (800) is securely coupled to the tether (500), the tether may then be coupled to a package housing (1100), a set of instruction sheets, an ornamental housing, a child resistant housing, etc. Additionally, as illustrated in FIG. 11B, the tether (500) may have a number of folds (530) configured to orient the fold-over card assembly (800) parallel to the tether (500), thereby allowing the assembly (800) to be housed in a compact package housing (1100). While a single housing configuration is illustrated in FIGS. 11A and 11B, a variety of pharmaceutical package housings (1100) of various configurations, including those used in child-resistant package configurations, may be coupled to the tether (500) including, but in no way limited to, child-resistant package housing.

Figure 12A:
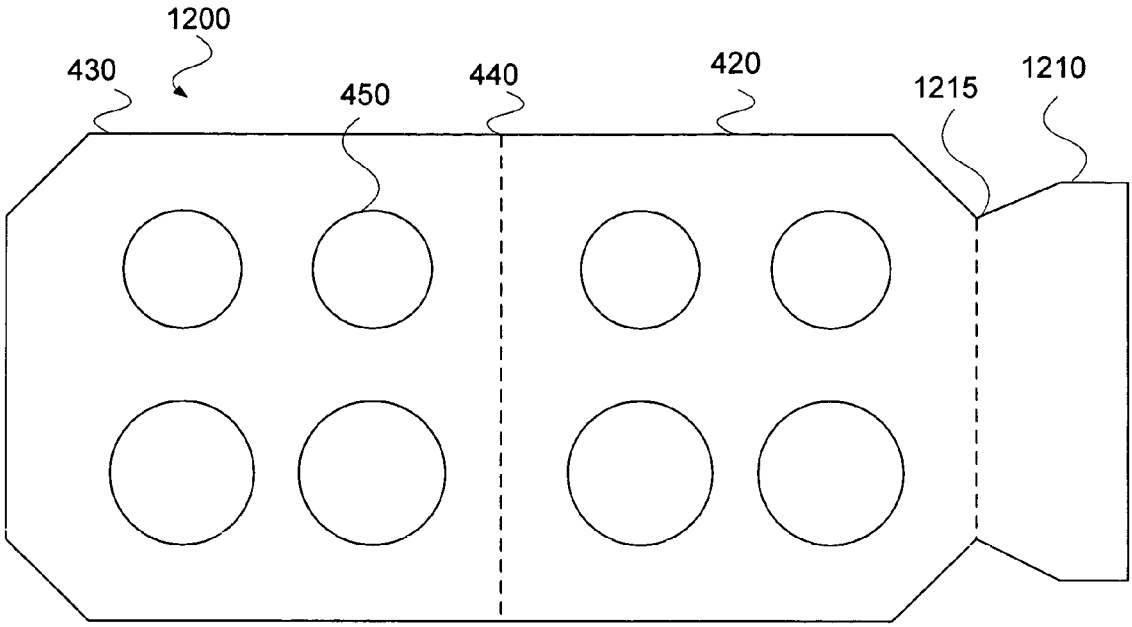
FIGS. 12A and 12B are top views illustrating a pre-assembly blister card and associated tether, according to one alternative embodiment.
Figure 12B:
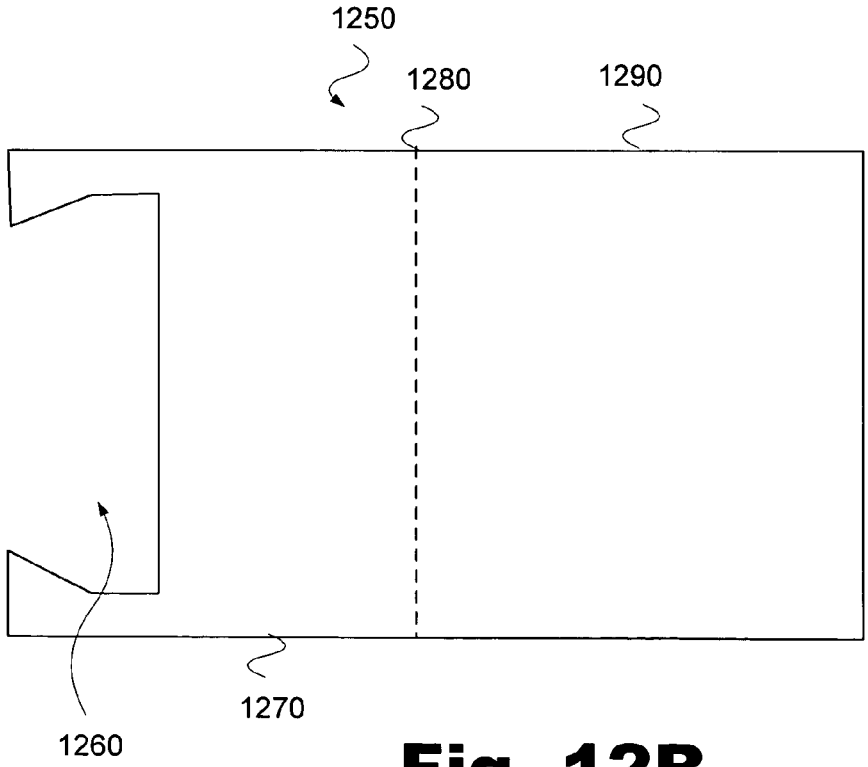

While the above-mentioned exemplary embodiments have been described in the context of fold-over cards including tether receiving recesses and mating tethers having recess matching extrusions, a number of alternative configurations may be used to form a customizable fold-over card assembly and associated tether without varying from the present system and method. FIGS. 12A and 12B illustrate an alternative customizable fold-over card and associated tether assembly respectively.

As illustrated in FIG. 12A, a fold-over card (1200) including pharmaceutical access orifices (450) may be formed having a card front (430) and a card back (420) configured to be folded along a crease (440), in a similar manner to the fold-over card (400) illustrated in FIG. 4. However, in contrast to the exemplary embodiment illustrated in FIG. 4, the fold-over card (1200) shown in FIG. 12 may also include a tether mating member (1210) in the form of a tab. Further, a second crease (1215) separates the tether mating member (1210) from the card back (420).

FIG. 12B illustrates an exemplary tether (1250) configured to correspond with the fold-over card (1200) illustrated in FIG. 12A. As illustrated, the tether (1250) includes a front portion (1270) and a back portion (1290), separated by a crease (1280). The exemplary tether (1250) also includes a fold-over card mating member (1260) in the form of a recess having a profile substantially similar to that of the tether mating member (1210; FIG. 12A) of the fold-over card (1200; FIG. 12A). Consequently, when the tether (1250) is folded along the crease (1280), the fold-over card mating member (1260) exposes a portion of the back portion (1290), which may then be used as an adhesive interface to couple the tether mating member (1210) of the fold-over card (1200) to the tether (1250).

As illustrated above, the mating members associated with the fold-over card (1200) and the tether (1250) may assume any number of male or female configurations. Furthermore, the mating members may have varying profiles so long as they produce a bondable interface that may be used to couple the fold-over card (1200) to the tether (1250).

Moreover, while the present system and method are described in the context of a fold-over card having pharmaceutical access orifices (450) in both the card front (430) and the card back (420), a number of variations may be made to the fold-over card, according to the present system and method. According to one exemplary embodiment, the card back (420) may include a solid substrate having perforations formed therein configured to function as a child-resistant pull-tab.

Additionally, while the above-mentioned exemplary embodiments have been described in the context of forming a fold-over card for pharmaceuticals, the present systems and methods may be used to interchangeably couple any number of blister packs and their associated fold-over cards to a package housing. Consequently, the present systems and methods may be used to couple a tether and fold-over blister pack configuration to blister packs containing any number of items such as, but in no way limited to, sterile instruments, electronics, and/or contact lenses.

In conclusion, the present systems and methods for independently forming fold-over card assemblies and associated tethers allows for the independent modification of either the fold-over card assembly or the tether without the added cost and delay associated with re-tooling and producing an entire fold-over card assembly and tether configuration. More specifically, if a customized pharmaceutical configuration is desired, re-tooling and fabrication is limited to producing the desired blister packs and their fold-over card assemblies, thereby saving the time and money of re-tooling for a modified tether. Similarly, if a new package housing is developed or desired, a corresponding tether may be designed, fabricated, and coupled to a pre-existing fold-over card configuration. This reduction in re-tooling time and cost reduces the production time for offering a new pharmaceutical product configuration to the market.

The preceding description has been presented only to illustrate and describe exemplary embodiments of the present systems and methods. It is not intended to be exhaustive or to limit the systems and methods to any precise form disclosed. Many modifications and variations are possible in light of the above teaching. It is intended that the scope of the systems and methods be defined by the following claims.

What is claimed is:

1. A pharmaceutical package assembly comprising:
- a tether comprising:
  - a fold-over card mating member; and
  - a housing mating member configured to be coupled to a package housing; and
- a fold-over card coupled to the tether and configured to house one or more pharmaceutical blisters, said fold-over card comprising:
  - a front member having a tether mating portion;
  - a back member being separated from the front member by a crease; and
  - a tether receiving recess formed on said back member such that when said fold-over card is folded along said crease, said tether mating portion of said front member remains exposed.

2. The pharmaceutical package of claim 1, wherein said front member is configured to be foldably coupled to said back member.

3. The pharmaceutical package of claim 2, farther comprising:
- at least one pharmaceutical access orifice formed in the front member; and
- at least one pharmaceutical access orifice formed in the back member;
- wherein said pharmaceutical access orifice formed in the front member is configured to be concentrically aligned with said pharmaceutical access orifice formed in the back member when said fold-over card is folded along said crease.

4. The pharmaceutical package of claim 1, wherein said tether mating portion of said front member is coupled to said fold-over card mating member by an adhesive.

5. The pharmaceutical package of claim 4, wherein said adhesive comprises a heat seal adhesive.

6. The pharmaceutical package of claim 1, wherein said fold-over card mating member and said tether receiving recess comprise mating equivalents.

7. The pharmaceutical package of claim 1, further comprising at least one pharmaceutical access orifice formed in said fold-over card.

8. The pharmaceutical package of claim 7, wherein said pharmaceutical package secures at least one pharmaceutical blister in said at least one pharmaceutical access orifice formed in said card front.

9. A pharmaceutical package assembly comprising:
- a tether including a fold-over card mating member;
- a fold-over card configured to house one or more pharmaceutical blisters; said fold-over card including
  - a front member having a tether mating portion,
  - a back member including a tether receiving recess, and
  - a crease separating said front member and said back member; and said tether receiving recess being formed on said back member such that when said fold-over card is folded along said crease, said tether mating portion of said front member remains exposed.

10. The pharmaceutical package of claim 9, wherein said front member is configured to be foldably coupled to said back member.

11. The pharmaceutical package of claim 10, further comprising:
- at least one pharmaceutical access orifice formed in the front member; and
- at least one pharmaceutical access orifice formed in the back member;
- wherein said pharmaceutical access orifice formed in the front member is configured to be concentrically aligned with said pharmaceutical access orifice formed in the back member when said fold-over card is folded along said crease.

12. The pharmaceutical package of claim 11, wherein said pharmaceutical package is configured to secure at least one pharmaceutical blister in said at least one pharmaceutical access orifice formed in said card front.

13. The pharmaceutical package of claim 9, wherein said tether mating portion of said front member is coupled to said card mating member by an adhesive.

14. The pharmaceutical package of claim 13, wherein said adhesive comprises a heat seal adhesive.

15. The pharmaceutical package of claim 9, wherein said fold-over card mating member and said tether receiving recess comprise mating equivalents.

16. A pharmaceutical package assembly comprising:
- a tether including a fold-over card mating member;
- a fold-over card configured to house one or more pharmaceutical blisters; said fold-over card including
  - a front member having a tether mating portion corresponding to said fold-over card mating member and a pharmaceutical access orifice configured to secure at least one pharmaceutical blister,
  - a back member including a tether receiving recess, and
  - a crease separating said front member and said back member, said front member being configured to be foldably coupled to said back member; and said tether receiving recess being formed on said back member such that when said fold-over card is folded along said crease, said tether mating portion of said front member remains exposed, said tether mating portion of said front member being configured to be coupled to said card mating member by an adhesive.

17. The pharmaceutical package of claim 16, further comprising: at least one pharmaceutical access orifice formed in the back member; wherein said pharmaceutical access orifice formed in the front member is concentrically aligned with said pharmaceutical access orifice formed in the back member when said fold-over card is folded along said crease.

18. The pharmaceutical package of claim 17, wherein said adhesive comprises a heat seal adhesive.

19. A pharmaceutical package comprising:

a tether coupled to a package housing, wherein said tether includes a fold-over card mating member; and a fold-over card configured to house one or more blister cards, said fold-over card including a front section, a back section and a tether mating member, the tether mating member comprising a receiving recess configured such that when said fold-over card is folded, overlapping said front section and said back section, a tether adhering portion of said fold-over card remains exposed, said tether adhering portion being coupled to said card mating member by an adhesive.

20. The pharmaceutical package of claim 19, wherein said adhesive comprises a heat seal adhesive.

21. A blister package assembly comprising:

a tether including a fold-over card mating member;

a fold-over card configured to house one or more blister package blisters; said fold-over card including a tether mating member and comprising:

a front member having a tether mating portion;

a back member including a tether receiving recess; and a crease separating said front member and said back member, said tether receiving recess being formed on said back member such that when said fold-over card is folded along said crease, said tether mating portion of said front member remains exposed.

22. The blister package assembly of claim 21, wherein said front member is configured to be foldably coupled to said back member.

23. The blister package assembly of claim 21, further comprising:

at least one blister package access orifice formed in the front member; and at least one blister package access orifice formed in the back member;

wherein said blister package access orifice formed in the front member is concentrically aligned with said blister package access orifice formed in the back member when said fold-over card is folded along said crease.

24. The blister package assembly of claim 21, wherein said tether mating portion of said fold-over card is coupled to said card mating member by a heat seal adhesive.

25. The pharmaceutical package of claim 9, wherein the tether mating portion of the front member of the fold-over card is coupled to the fold-over card mating member of the tether.

26. The pharmaceutical package assembly of claim 16, wherein the tether mating portion of the front member of the fold-over card is coupled to the card mating member of the tether by the adhesive.

27. A pharmaceutical package assembly comprising:

a tether comprising:

a front portion; and a back portion separated from the front portion by a first crease, a recess being formed on the front portion such that when the tether is folded along the first crease, a portion of the back portion remains exposed; and a fold-over card configured to house one or more pharmaceutical blisters, the fold-over card comprising:

a front member;

a back member separated from the front member by a second crease; and a tether mating member coupled to the back member, the tether mating member being configured to be received within the recess formed on the front portion of the tether.

28. The pharmaceutical package assembly of claim 27, wherein the tether mating member is attached to the portion of the back portion that is exposed.

29. The pharmaceutical package assembly of claim 27, wherein the front portion of the tether is foldably coupled to the back portion of the tether.

30. The pharmaceutical package assembly of claim 27, wherein the front member of the fold-over card is foldably coupled to the back member of the fold-over card.

31. The pharmaceutical package of claim 27, further comprising:

a first pharmaceutical access orifice formed in the front member; and a second pharmaceutical access orifice formed in the back member;

wherein the first pharmaceutical access orifice is concentrically aligned with the second pharmaceutical access orifice when the fold-over card is folded along the first crease.

32. The pharmaceutical package of claim 31, wherein the pharmaceutical package secures a pharmaceutical blister in the first pharmaceutical access orifice.

33. The pharmaceutical package assembly of claim 1, further comprising:

a package housing, wherein the housing mating member of the tether is coupled to the package housing.

34. The pharmaceutical package assembly of claim 33, wherein the package housing bounds a compartment such that the tether and the fold-over card can selectively slide into and out of the compartment when the housing mating member is coupled to the package housing.

* * * * *

UNITED STATES PATENT AND TRADEMARK OFFICE

CERTIFICATE OF CORRECTION

PATENT NO. : 7,325,689 B2
APPLICATION NO. : 10/925235
DATED : February 5, 2008
INVENTOR(S) : Buss It is certified that error appears in the above-identified patent and that said Letters Patent is hereby corrected as shown below:

Column 4
Line 38, change “110” to --100--

Column 5
Lines 3-4, remove “(120; FIG. 1)”

Column 7
Line 1, after “surface” insert --(810)--
Line 12, change “410” to --430--

Column 8
Line 1, after “back” insert --420--

Column 9
Line 54, change “farther” to --further--

Signed and Sealed this

Twenty-third Day of September, 2008

JON W. DUDAS
*Director of the United States Patent and Trademark Office*